US005448857A

United States Patent [19]

Stormo

[11] Patent Number: 5,448,857

[45] Date of Patent: Sep. 12, 1995

[54] LOCKING SYSTEM FOR A DOUBLE HUNG WINDOW

[75] Inventor: Guy C. Stormo, Owatonna, Minn.

[73] Assignee: Truth Hardware Corporation, Owatonna, Minn.

[21] Appl. No.: 217,927

[22] Filed: Mar. 25, 1994

[51] Int. Cl.[6] ..... E05D 15/16

[52] U.S. Cl. ..... 49/417; 49/434; 49/450; 49/454

[58] Field of Search ..... 49/417, 450, 449, 422, 49/434, 452, 454

[56] References Cited

U.S. PATENT DOCUMENTS

| | | | |
|---|---|---|---|
| 3,109,675 | 11/1963 | Anderson . | |
| 3,116,520 | 1/1964 | MacGregor | 49/422 |
| 3,153,818 | 10/1964 | Osten, Sr. | 49/422 X |
| 3,228,068 | 1/1966 | Trout | 49/417 |
| 3,377,747 | 4/1968 | Donkin | 49/450 X |
| 3,394,955 | 7/1968 | Martin . | |
| 3,473,263 | 10/1969 | Osten, Sr. | 49/417 X |
| 3,706,467 | 12/1972 | Martin . | |
| 3,811,718 | 3/1974 | Bates . | |
| 4,095,827 | 6/1978 | Stavenau . | |
| 4,095,829 | 6/1978 | Van Klompenburg . | |
| 4,261,602 | 4/1981 | Anderson . | |
| 4,736,972 | 4/1988 | Mosch . | |
| 4,801,164 | 1/1989 | Mosch . | |
| 4,813,725 | 3/1989 | Mosch . | |
| 5,161,839 | 11/1992 | Piltingsrud et al. . | |
| 5,219,193 | 6/1993 | Piltingsrud . | |

*Primary Examiner*—Philip C. Kannan
*Attorney, Agent, or Firm*—Wood, Phillips, VanSanten, Clark & Mortimer

[57] ABSTRACT

An apparatus for selectively securing a window sash to a window frame, including a longitudinally extending jamb liner secured to the frame adjacent one side of the sash, and a movable cam between the frame and the liner for selectively adjusting the spacing therebetween. Frictional locking surfaces are provided between the liner and the sash whereby the cam in a locking configuration biases the liner away from the frame and thereby against the sash to frictionally lock the sash against movement relative to the liner. The liner defines a portion of the track guiding the sash for substantially planar movement and the cam may also be selectively moved to a releasing configuration allowing the liner to sufficiently approach the frame to allow the sash to be cleared from the liner. The cam preferably includes a first set of cam members resiliently secured to the liner at spaced positions along its length, and a second cooperating set of cam members is movable to selectively adjust the overall lateral dimension of the cooperating cam members in the space between the liner and the frame.

28 Claims, 2 Drawing Sheets

Fig. 2
Fig. 1
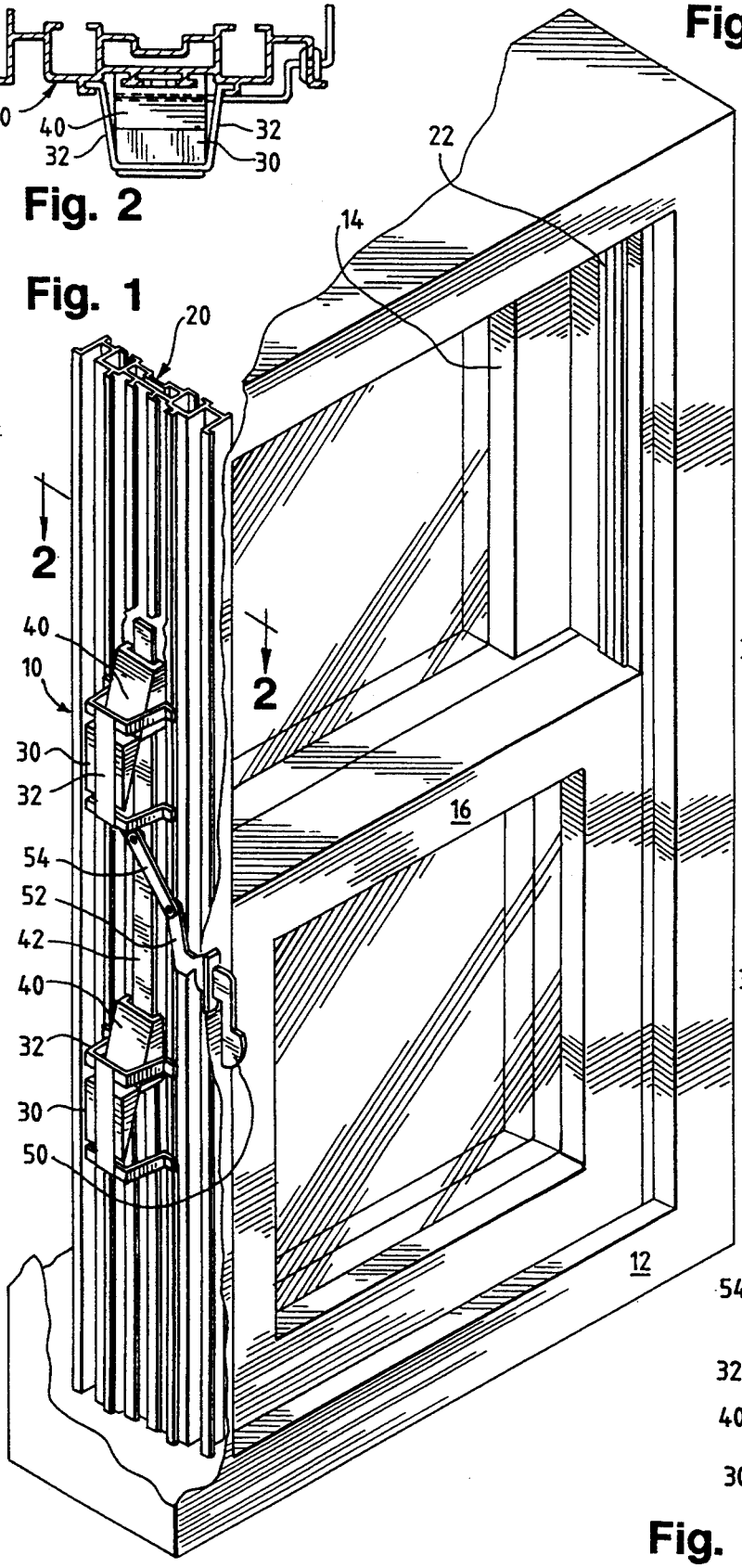
Fig. 3
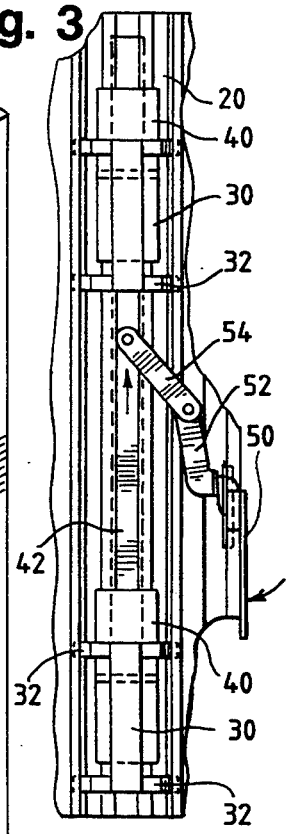
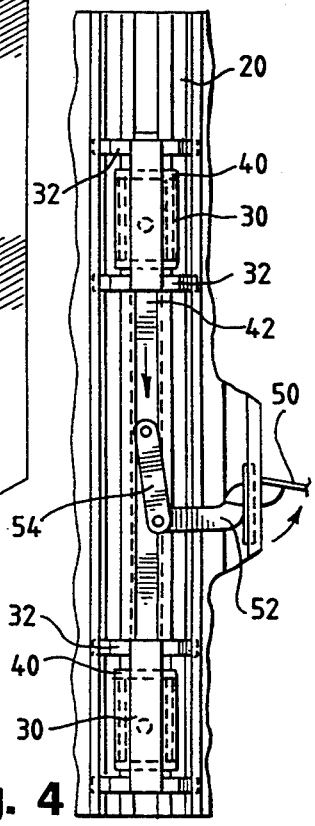
Fig. 4

LOCKING SYSTEM FOR A DOUBLE HUNG WINDOW

BACKGROUND OF THE INVENTION

1. Technical Field

The present invention is directed toward windows, and more particularly toward a structure for controlling operation of a sash of a double hung window.

2. Background Art

Double hung windows are well known in the art, and include a pair of sashes generally movable in parallel planar paths whereby the window opening may be half opened by moving one sash into an overlapping position with the other sash. Typically, such operation is accomplished by raising and lowering the inner sash (i.e., the sash moving in the path closest to the interior of the room) with the outer sash being generally secured at the upper end of its path. In ideal double hung windows, it is preferable that there be an ability to easily remove the sash for maintenance as well as (as is becoming increasingly popular) an ability to tilt in the bottom sash so that the outer surface of its pane may be reached from the interior of the room for washing.

Locking is typically provided by cam locks, such as check rail locks, in which the two sashes are mechanically secured to one another when in the closed non-overlapping position to prevent movement relative to one another. Such locks are generally required to be disposed on top of the lower sash, which in some installations can be difficult to reach (for example, with tall window sashes or windows located higher on the wall than normal).

Such locks are also susceptible to breaking when forced in that the entire locking occurs at the particular location of the lock. Therefore, if an intruder tries to force the window, the entry force is resisted solely at the one point (where the sash lock is secured to the sash). Breaking of the lock, or particularly the wooden or PVC sash, is thus a distinct possibility due to the resulting stress concentrations at the lock location.

Still further, since such locks are generally disposed in the middle of the opening, they can be an undesirable visual intrusion on the view through the glass in the upper sash. One structure which has been used in order to minimize such a visual intrusion is the concealed check rail lock disclosed in U.S. Pat. No. 4,813,725, but even that advantageous structure requires that the handle be accessible and therefore visible.

Counterbalancing weights or compensating springs are also typically used with sashes of double hung windows to make it easier for a person to raise such sashes. The sashes are typically held in open venting positions by a combination of the counterbalancing weights or springs and some frictional binding of the sash in its track. Of course, such necessary binding also, unfortunately, also occurs when moving the sash to thereby increase the effort required to open and close the window. There is, therefore, typically some design balance which is required between minimizing binding to ease operation while maintaining some amount of binding to prevent the sash from falling closed (and possibly injuring a person, particularly a child, who might have their hands or head in the opening). Of course, even a proper initial design balance will often fail over time, as evidenced by the not uncommon occurrence of older windows which today are kept open only by wedging something such as a board beneath the sash (in which case, people typically will open the window to one venting position—that provided by the board they have next to the window).

While the connection of the moving sash to the frame is obviously important to operation of the window as discussed above, it is also an area which is susceptible to undesirable air drafts and energy loss, since tight connections between the frame and the sash to prevent such loss would undesirably tend to bind the sash to the frame and thereby significantly increase the force required to move the sash. Such constraints similarly tend to limit the types of gaskets which can be used to try to reduce the energy loss between the sash and the frame.

Other structures have been used, typically in storm windows, in which the sash may be mechanically secured in a variety of raised positions by outwardly biased pins receivable in openings spaced along the track. Such structures when properly operating will secure the sash at a discrete number of venting positions. However, they are difficult to operate as operation of the sash typically requires that the person pull in the pins on both sides of the sash while moving the sash. Further, such structures are susceptible to failure as can occur when dirt and grime binds the pin against extending outwardly into a locking position, or if the pin is not properly seated in the track openings (in which case, just a little bump could cause the sash to fall and damage the sash and anything under it).

The present invention is directed toward overcoming one or more of the problems set forth above.

SUMMARY OF THE INVENTION

In one aspect of the present invention, an apparatus for selectively securing a window sash to a window frame is provided, including a longitudinally extending jamb liner secured to the frame adjacent one side of the sash, and means for selectively adjusting the spacing between the frame and the liner.

In another aspect of the present invention, spacing adjustment between the frame and the liner is provided by a selectively movable cam disposed between the frame and the liner.

In still another aspect of the present invention, frictional locking surfaces are provided between the liner and the sash, and the cam may be selectively positioned to bias the liner away from the frame and thereby against the sash to frictionally lock the sash against movement relative to the liner.

In one preferred form of this invention, the liner defines a portion of the track guiding the sash for substantially planar movement, and the cam may be selectively moved between a locking configuration biasing the liner against the sash and a releasing configuration allowing the liner to sufficiently approach the frame to allow the sash to be cleared from the liner.

In a further preferred form of this invention, a first set of cam members is resiliently secured to the liner at spaced positions along its length, and a second cooperating set of cam members is movable to selectively adjust the overall lateral dimension of the cooperating cam members in the space between the liner and the frame.

It is an object of the invention to provide a structure permitting easy and inexpensive mounting of a double hung window.

It is another object of the invention to provide a double hung window in which the sash may be easily removed for maintenance and/or tilted for washing.

It is still another object of the invention to provide a double hung window which will minimize air infiltration and related energy loss.

It is yet another object of the invention to provide a double hung window which may be easily operated without binding when opening and closing the sash.

Another object of the invention is to provide a double hung window which may be easily and securely locked with minimal manual force.

Yet another object of the invention is to provide a double hung window which may be easily and securely locked not only in the closed position but also in an infinite number of open venting positions.

Still another object of the present invention is to provide a double hung window in which the lock actuator may be disposed at a variety of heights for easy access in all window installations.

Yet another object of the present invention is to provide a double hung window which is aesthetically pleasing with minimal visual intrusion by the locking hardware.

BRIEF DESCRIPTION OF THE DRAWINGS

FIG. 1 is a partially broken away perspective view of a double hung window including the locking system of the present invention;

FIG. 2 is a cross sectional view of the locking system, taken through line 2—2 of FIG. 1;

FIG. 3 is a side view showing the locking system in a locking configuration;

FIG. 4 is a side view showing the locking system in a releasing configuration;

DESCRIPTION OF THE PREFERRED EMBODIMENT

Figure 5:
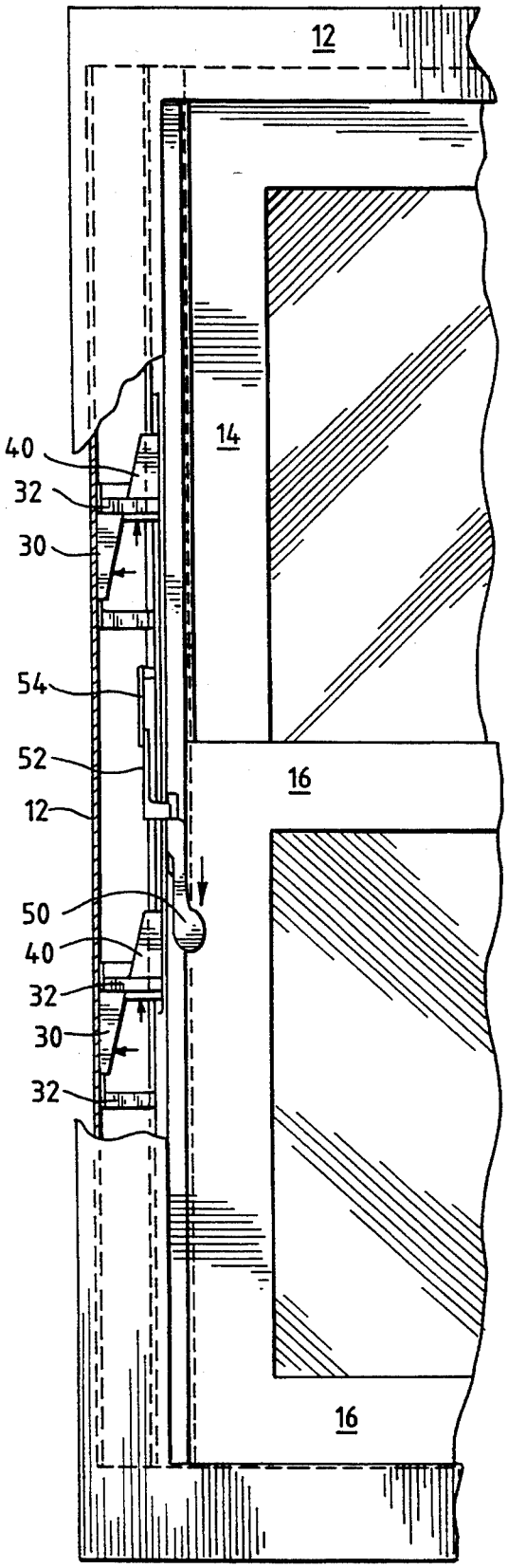
FIG. 5 is a front view of the double hung window, partially broken away to show the locking system in the locking configuration.

The locking system 10 for a double hung window is shown generally in FIG. 1, with a window frame 12 mounting an upper sash 14 and lower sash 16 in generally parallel vertical positions. Both sashes 14, 16 are mounted for generally planar movement up and down within the frame 12 for opening and closing the window, with the upper sash 14 being disposed at the upper end of its movement and the lower sash 16 being disposed at the lower end of its movement when the window is closed. Generally, the lower sash 16 is disposed toward the interior of the enclosure relative to the upper sash 14.

As will be apparent from the full disclosure below, the present invention could be advantageously used in window type other than double hung windows. As one example, the locking system could be readily used with a single hung window in only one sash, typically the lower sash, is movable.

Jamb liners 20, 22 made of a suitable material, such as extruded vinyl, are preferably provided on both sides of the frame 12 and mate with the sides of the sashes 14, 16 to hold the sashes 14, 16 to the frame 12, to define a substantially vertical track guiding the lower sash 16 in the desired substantially planar vertical motion, and to assist in providing a weather seal to block air drafts and energy loss around the sides of the sashes 14, 16.

The locking system 10 of the present invention is associated with the liner 20 on one side of the window.

The system 10 includes a plurality of vertically spaced and tapered cam members 30 secured to the liner 20 by resilient braces 32 which permit lateral horizontal motion of the cam members 30 relative to the liner but substantially restrain the cam members 30 against vertical movement. Securing the cam members 30 to the liner 20 in such a manner is a preferred form since, as will be apparent from the full disclosure herein, this enables the locking system 10 to be assembled with the liner 20 prior to installation in a window to not only ease assembly but also assist with inventorying of the locking system 10. It should be understood, however, that it would be within the scope of the invention as claimed herein for the cam members 30 to be held against vertical movement in a different way, as by fixing them to the frame 12.

Still further, it should be understood that while only two cam members 30 are shown, more could be used within the scope of the invention to ensure a uniform operation of the locking system 10, as might be preferred particularly with tall windows.

A second set of oppositely tapered cam members 40 is suitably secured to a longitudinally extending tie bar 42 at a spacing substantially the same as that of the first cam members 30.

A pivoting handle 50 is suitably secured to the tie bar 42 so that pivoting of the handle 50 will cause the tie bar 42 and attached cam members 40 to move vertically up or down. In the embodiment shown in the figures, the handle 50 includes an arm 52 on its inner side, which arm 52 is pivotally secured to one end of a link 54 which is pivotally secured on the other end to the tie bar 42. Thus, pivoting the handle 50 down as shown in FIGS. 2 and 3 moves the tie bar 42 up into a locking configuration as described below and pivoting of the handle 50 up as shown in FIG. 4 moves the tie bar 42 down into a releasing configuration as also described below.

It should be recognized that the present invention may be easily and inexpensively mounted to a double hung window. Still further, it should be recognized that the handle 50 could be pivotally mounted at any height along the side of the window (it need not be centrally connected to the tie bar 42), so that the system 10 can be readily used with virtually any window installation with the handle 50 located such that it can be easily reached for operation. Special mounting, such as a low handle position for a child's room, can thus be readily accommodated.

Of course, still other linkage structures connecting the handle 50 to the tie bar 42 could be used including, for example, a slot in the handle arm receiving a pin on the tie bar. Moreover, it should be understood that a wide variety of structure, both manual and motorized, could also be used to move the tie bar 42 up or down to accomplish locking and releasing of the sash 16 as described below.

It should also be understood that the above described cam structure is a preferred form of the locking system 10, and that still other structures for adjusting the spacing and biasing force between the frame 12 and the liner 20 could also be used within the scope of the present invention.

Further, while reference is generally made herein to movement and locking of the lower sash 16, it should be understood that the same type of movement and locking of the upper sash 14 is also readily accomplished with the locking system 10. It should be understood that each such sash 14, 16 should preferably have counterbalancing weights or compensating springs which substantially offset the weight of each sash, although preferably the counterbalancing force on the upper sash 14 should be slightly greater than the weight of the upper sash 14 and the counterbalancing force on the lower sash 16 should be slightly less than the weight of the lower sash 16. Such counterbalancing forces thus tend to raise the upper sash 14 and lower the lower sash 16 to their closed positions when the locking system 10 is disengaged. Due to the substantial reduction in binding forces on the sashes 14, 16 during movement, a near balancing of such forces is desired (i.e., with the difference between the counterbalancing force and sash weight being very little) so that the sashes 14, 16 do not fall or move up quickly when the locking system 10 is disengaged to allow movement.

Still other variations of the locking system 10 should further be recognized. That is, the system 10 could be used in connection with both single and double hung windows as previously noted. Still further, the locking system 10 could be used to separately lock the two sashes of a double hung window by, for example, providing side by side separate jamb liners with separate cam structures and separate handles, where operation of one handle would bias one of the liners extending along the path of one of the sashes to selectively lock it in position, and operation of the other handle would bias the other parallel liner adjacent the other sash to selectively lock it in position.

As best seen in FIG. 5, with the handle 50 down in the locking configuration, the cam members 30, 40 cooperate to essentially fill the space between the window frame 12 and the jamb liner 20. When the tie bar 42 is fully biased up by the down handle 50 as shown, the second set of cam members 40 are strongly biased away from the first set of cam members 30 bearing on the window frame 12 so as to in turn strongly bias the jamb liner 20 against the sashes 14, 16. This strong force normal to the adjacent surfaces of the sashes 14, 16 and liner 20 thus maximizes the frictional force between the liner 20 (and the liner 22 on the other side) and the sashes 14, 16 so as to effectively lock the sashes 14, 16 against movement.

Such frictional locking can be enhanced by forming at least a portion of the liners 20, 22 of a high friction material, including in particular a resilient material which will conform into any irregularities in the sides of the sash 16. Also, while it is within the scope of the present invention to have relatively smooth frictionally binding surfaces between the frame 12 and the sash 16, it should also be understood that rougher surfaces, such as serrated surfaces, could be used if desired to enhance the binding of the sash 16 when the liner 20 is biased against it.

Locking in the above described manner may, through selection of an appropriate taper to the cam members 30, 40, be accomplished with minimal force, so that manual operation my be accomplished by children or senior citizens without straining. Still further, as the locking force is essentially applied along the length of both sides of the sash, there are no stress concentrations susceptible to breakage such as might occur, for example, to permit a forced entry.

Figure 6:
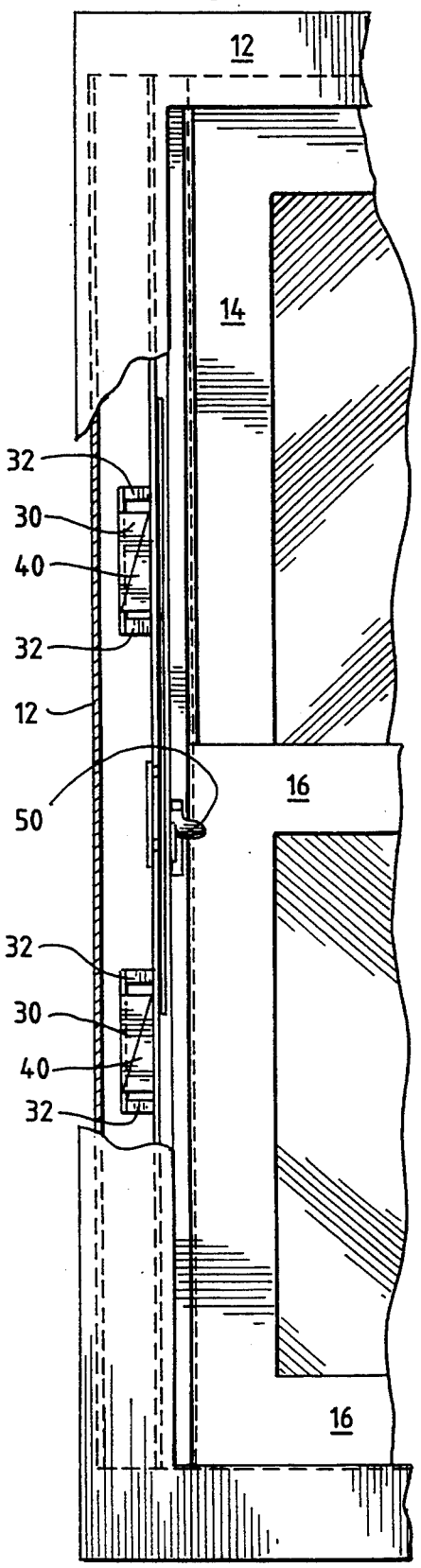
FIG. 6 is a front view similar to FIG. 5, but showing the locking system in the releasing configuration.

Upward pivoting of the handle 50 as shown in FIGS. 4 and 6 alternatively positions the cam members 30, 40 so as to present a minimum lateral dimension whereby the jamb 20 is not biased against the sashes 14, 16 and could further be flexed, if desired, toward the frame 12 and away from the sashes 14, 16. As a result, there will be virtually no binding or resistance of the sashes 14, 16 when a person chooses to change the position of either to, for example, some intermediate venting position. Further, after the sashes 14, 16 are moved, the handle 50 may be pivoted back down to secure the sashes 14, 16 in a virtually infinite number of venting positions.

The freedom of the jamb 20 to flex away from the sashes 14, 16 also allows the sashes 14, 16 to be readily removed if desired for maintenance and also makes the lower sash 16 readily adaptable to tilt-in operation for washing.

Still further, the ability to essentially change the positioning of the jamb liner 20 relative to the sashes 14, 16 along the length of the sides of both sashes 14, 16 permits a good weather tight seal to be provided to virtually eliminate air drafts and minimize energy loss. Such a good seal is provided when the sashes 14, 16 are locked not only by the fact that a compressive seal is provided along the sides but also by the ability to use good seals in the window, such as interlocking gaskets, without interfering with the free movement of the sashes 14, 16 as would otherwise occur on conventional double hung windows.

Of course, since the entire locking system 10 is disposed along the side of the window, it presents no intrusion whatsoever to the view through the window.

Still other aspects, objects, and advantages of the present invention can be obtained from a study of the specification, the drawings, and the appended claims.

I claim:

1. A mounting and locking structure for a sash of a double hung window, said sash being movable in a planar path relative to a window frame, comprising:

a jamb liner securable to a window frame and extending in a longitudinal direction adjacent one side of the window sash, said liner defining a guide track for said one sash side during planar movement of the sash relative to the frame; and means for selectively biasing said jamb liner against said sash side to frictionally lock said sash in a selected position relative to the frame.

2. The structure of claim 1, wherein said biasing means in a locking configuration biases the liner away from the frame and against the sash, and said biasing means in a releasing configuration releases the liner to freely approach the frame sufficiently to allow the sash to be cleared from the liner.

3. The structure of claim 2, wherein the liner is flexible.

4. The structure of claim 1, wherein the locking and mounting structure further operates on a second sash of the double hung window, said second sash being movable in a planar path parallel to the planar path of the first sash with said jamb liner extending adjacent one side of both sashes and further defining a guide track for the second sash.

5. The structure of claim 4, further comprising:

means for biasing said first sash upward with a force which is less than the weight of the first sash; and means for biasing said second sash upward with a force which is greater than the weight of the second sash;

wherein when the window is closed the first sash is lowered to the bottom of its path and the second sash is raised to the top of its path.

6. A mounting and locking structure for a sash of a double hung window, said sash being movable in a planar path relative to a window frame, comprising:

a jamb liner securable to a window frame and extending in a longitudinal direction adjacent one side of the window sash, said liner defining a guide track for said one sash side during planar movement of the sash relative to the frame; and means for selectively biasing said jamb liner against said sash side, wherein said biasing means includes a first cam secured between the frame and liner; and a second cam movable between the frame and liner and cooperating with the first cam to selectively adjust the spacing between said frame and said liner.

7. The structure of claim 6, wherein said first cam comprises a first set of cam members and said second cam comprises a second set of cam members cooperating with the cam members of the first set, the cam members of each set being spaced apart along the longitudinal direction of the jamb liner.

8. The structure of claim 7 further comprising resilient connectors securing said cam members of said first set to said liner with said cam members of said second set disposed between said first set cam members and said liner, whereby at least one of each cooperating cam member is tapered so that movement of the cam members of the second set changes the overall lateral dimension of the cooperating cam members in the space between the liner and the frame.

9. The structure of claim 8, wherein said cam members of said second set are connected to a substantially rigid tie bar extending longitudinally between the liner and the frame.

10. The structure of claim 6, further comprising frictional locking surfaces between said liner and said sash, and selected longitudinal movement of said second cam biases said liner against said sash to frictionally lock said sash against movement relative to said liner.

11. An apparatus for selectively securing a window sash to a window frame, comprising:

a longitudinally extending jamb liner secured to said frame adjacent one side of the sash;

means for selectively exerting a force between the frame and the liner in a lateral direction relative to the longitudinal direction of the liner wherein the exerting means in a securing configuration biases the liner away from the frame and against the sash to frictionally lock the sash against movement relative to the liner, wherein said force exerting means may be selectively operated in any position of the sash relative to the frame.

12. The apparatus of claim 11, wherein said exerting means in a releasing configuration releases the liner to freely approach the frame sufficiently to allow the sash to be cleared from the liner.

13. The apparatus of claim 12, wherein said sash is guided for substantially planar movement by a track and said liner defines a portion of the track for the sash.

14. The apparatus of claim 11, wherein the exerting means is selectively adjustable for adjusting the spacing between the frame and the liner.

15. The apparatus of claim 11, wherein the selective force exerting means includes a handle which projects in a direction transverse to said lateral direction between the frame and the liner.

16. An apparatus for selectively securing a window sash to a window frame, comprising:

a longitudinally extending jamb liner secured to said frame adjacent one side of the sash;

means for selectively exerting a force between the frame and the liner in a lateral direction relative to the longitudinal direction of the liner said exerting means being selectively adjustable for adjusting the spacing between the frame and the liner to bias the liner into securing engagement with the sash, said exerting means including a first cam secured relative to the frame and liner; and a second cam movable between the frame and liner cooperating with the first cam.

17. The apparatus of claim 16, wherein said first cam comprises a first set of cam members and said second cam comprises a second set of cam members cooperating with the cam members of the first set, the cam members of each set being longitudinally spaced to provide a substantially uniform spacing adjustment along the liner.

18. The apparatus of claim 17, further comprising resilient connectors securing said cam members of said first set to said liner with said cam members of said second set disposed between said first set cam members and said liner, whereby at least one of each cooperating cam member is tapered so that longitudinal movement of the cam members of the second set changes the overall lateral dimension of the cooperating cam members in the space between the liner and the frame.

19. The apparatus of claim 18, wherein said cam members of said second set are connected to a substantially rigid tie bar extending longitudinally between the liner and the frame.

20. The apparatus of claim 16, further comprising frictional locking surfaces on said liner and said sash, and selected movement of said second cam cooperates with the first cam to bias said liner against said sash to frictionally lock said sash against movement relative to said liner.

21. An apparatus for selectively securing a window sash to a window frame, comprising:

a longitudinally extending jamb liner secured to said frame adjacent one side of the sash;

means for selectively adjusting the spacing between the frame and the liner in any position of the sash relative to the frame; and frictional locking surfaces on said liner and said sash whereby the adjusting means selectively increase the spacing between the frame and the liner to bias the liner surfaces against the sash surfaces to frictionally lock said sash against movement relative to said liner.

22. The apparatus of claim 21, wherein said adjusting means comprises a selectively movable cam between the frame and the liner.

23. The apparatus of claim 21, wherein said adjusting means in a locking configuration biases the liner away from the frame and against the sash, and said adjusting means in a releasing configuration allows the liner to sufficiently approach the frame to allow the sash to be cleared from the liner.

24. An apparatus for selectively securing a window sash of a double hung window to a window frame, comprising:

a longitudinally extending jamb liner secured to said frame adjacent one side of the sash, said liner defining a portion of the track guiding the sash for substantially planar movement;

a first set of cam members longitudinally spaced between the liner and the frame, said first set of cam members being substantially secured against longitudinal movement relative to the frame and liner;

a second set of cam members cooperating with the first set of cam members and selectively movable relative to the first set of cam members between a locking configuration biasing the liner away from the frame and against the sash and a releasing configuration with the liner movable toward the frame so that the sash may be cleared from the liner track and removed from the window.

25. The apparatus of claim 24, further comprising resilient connectors securing said cam members of said first set to said liner with said cam members of said second set disposed between said first set cam members and said liner, whereby at least one of each cooperating cam member is tapered so that longitudinal movement of the cam members of the second set changes the overall lateral dimension of the cooperating cam members in the space between the liner and the frame.

26. The apparatus of claim 25, wherein said cam members of said second set are connected to a substantially rigid tie bar extending longitudinally between the liner and the frame.

27. The apparatus of claim 24, wherein the apparatus further selectively secures a second window sash of a double hung window with said jamb liner extending adjacent one side of both sashes and further defining a portion of the track guiding the second sash for movement substantially parallel to the movement of the first sash.

28. The apparatus of claim 27, further comprising:

means for biasing said first sash upward with a force which is less than the weight of the first sash; and means for biasing said second sash upward with a force which is greater than the weight of the second sash;

wherein when the window is closed the first sash is lowered to the bottom of its path and the second sash is raised to the top of its path.

* * * * *